United States Patent [19]

Carter, Sr.

[11] Patent Number: 4,611,641

[45] Date of Patent: Sep. 16, 1986

[54] GAS MIXING DEVICE AND METHOD

[75] Inventor: Jerie W. Carter, Sr., Ocoee, Fla.

[73] Assignee: Mid-Florida Corporation, Orlando, Fla.

[21] Appl. No.: 720,971

[22] Filed: Apr. 8, 1985

[51] Int. Cl.[4] ..... B65B 3/04

[52] U.S. Cl. ..... 141/4; 141/100; 141/374; 141/9; 137/7

[58] Field of Search ..... 141/1-12, 141/100-110, 369-374; 137/3-7

[56] References Cited

U.S. PATENT DOCUMENTS 3,583,446 6/1971 Rush ..... 141/105

4,193,515 3/1980 Purdy ..... 141/105

*Primary Examiner*—Houston S. Bell, Jr.

*Attorney, Agent, or Firm*—Macdonald J. Wiggins

[57] ABSTRACT

A gas mixing device and method for filling gas storage cylinders with two or more diverse gases and automatically mixing the gases. A high pressure cylinder valve has an elongate hollow tube welded into the valve body and extending to the lower end of a storage cylinder. A plurality of holes through the tube sidewalls is distributed in a spiral along the length of the tube. Each gas is filled in order of its final pressure and distributed along the length of the cylinder thereby mixing with the other gases.

2 Claims, 3 Drawing Figures

FIG. 1
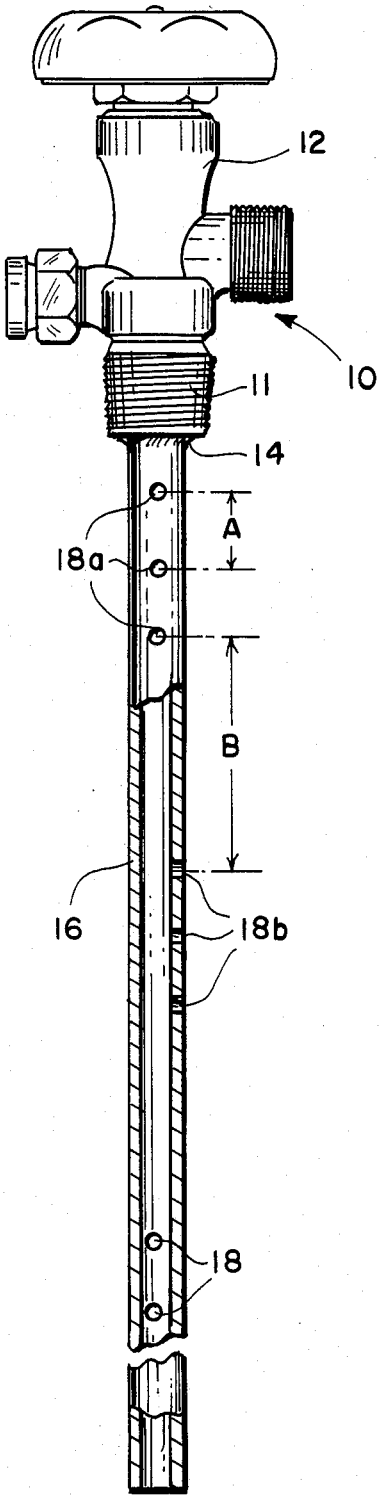
FIG. 2
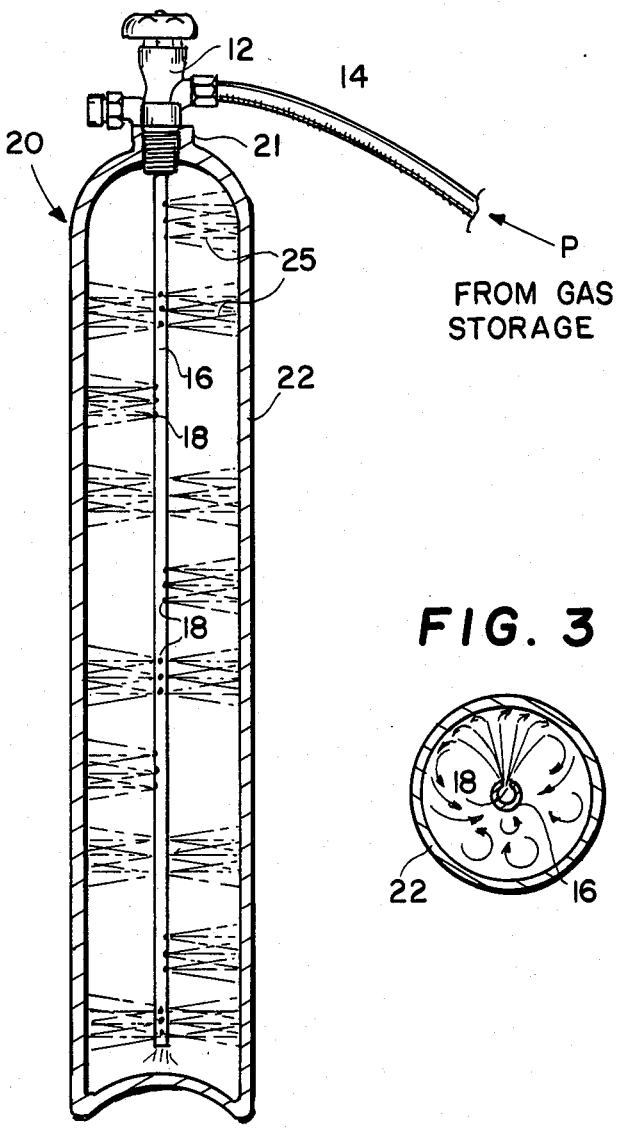
FIG. 3

GAS MIXING DEVICE AND METHOD

BACKGROUND OF THE INVENTION

1. Field of the Invention

The present invention relates to multiple gases installed in cylinders and more particularly to a device and method which permits gases to be automatically mixed when a cylinder is filled.

2. Description of the Prior Art

In the manufacture of industrial gases such as gas mixtures used for welding and the like, it is necessary to mix a specific amount of one or more gases with the active gases. For example, in heliarc welding, the mixture may be 90% helium, argon and 2% oxygen. Another typical industrial mixture is 75% argon and 25% carbon dioxide. The practice in filling cylinders is to identify the quantity of gas with the pressure under which it occurs assuming a standard atmospheric pressure. For example, in a 90% argon, 10% oxygen cylinder, oxygen is introduced into the empty cylinder to a pressure of 246 psi at 70° F. Argon is then introduced until a total pressure of 2,460 psi at 70° F. is reached. It is to be understood that these pressures are a function of temperature and therefore the filler must take this into account. After entering the gases as just described, it will be found that the gases will be stratified and not mixed due to the difference in weights and densities of the gases. Therefore, it is necessary to roll the cylinders for a period of time. To this end, rolling machines are provided upon which the cylinders are placed and rollers then will roll or tumble the cylinders. This requires a certain amount of time which may be from 5 to 30 minutes and also is costly in terms of energy and in damage to the finish of the cylinders, requiring frequent repainting.

Therefore, there has been a long felt need for a device used during the filling operation which automatically provides a homogeneous mixture of the gases in the cylinder.

SUMMARY OF THE INVENTION

The present invention is a simple modification to the high pressure cylinder valve which is installed in each cylinder. Prior to installation of the high pressure cylinder valve, a long metal mixing tube is silver-soldered or otherwised attached into the bore of the fitting which is installed in the neck of the cylinder. A series of small holes is drilled along the length of the mixing tube. Although various patterns of openings can be used, I have found it satisfactory to place ⅛" diameter holes in sets of three spaced vertically about one inch apart. A second group of three is drilled in the mixing tube at a 90° angle to the first set. This pattern is repeated down the mixing tube with the result that a plurality of groups of holes spiral around the mixing tube. Preferably, the mixing tube reaches within a short distance of the bottom of the cylinder.

The filling operation is carried out in conventional fashion. For the example mentioned above in which argon and oxygen are to be mixed in a 330 pound cylinder under standard temperature conditions, the oxygen is filled to the 246 psi point. As will be understood, the gas will be distributed the entire length of the cylinder since it will issue from each set of openings along the tube. Next, the argon is introduced to a final pressure of 2,460 psi. The gas will issue from each hole at a high velocity, will strike the inner sides of the cylinder, and will produce significant turbulence. This turbulence has the effect of completely mixing the argon with the oxygen during filling. Thus, when the tank is completely filled, it is found that complete mixing has been accomplished simultaneously.

As will be now understood, the mixing tube device of the invention saves time and wear and tear on the cylinders formerly required due to rolling by achieving full mixing during the filling operation. It will also be seen that, as gas is used from the cylinder, the gases in the cylinder external to the mixing tube will be drawn through the openings into the center of the pipe and out the valve. If there was settling of any of the gases during storage, the turbulence thus created would insure a good mixture.

It is therefore a principal object of my invention to provide a mixing device for filling cylinders with diverse gases such that, after filling, the various gases will be completely mixed.

It is another object of my invention to provide a mixing device having a elongate mixing tube attached to the cylinder high pressure valve and extending essentially to the bottom of the cylinder.

It is still another object of my invention to provide the valve with a mixing tube attached thereto in which holes are drilled through the sidewalls of the tubing in a spiral pattern from the top to the bottom of the tube.

These and other objects and advantages of my invention will become apparent from the following detailed description when read in conjunction with the drawings.

BRIEF DESCRIPTION OF THE DRAWINGS

FIG. 1 is a view of the high pressure valve used with my invention having the mixing tube installed therein;

FIG. 2 is a longitudinal cross-sectional view of a typical cylinder having the mixing device of FIG. 1 installed therein; and FIG. 3 is a lateral cross section of the cylinder of FIG. 2.

DETAILED DESCRIPTION OF THE PREFERRED EMBODIMENT

Turning first to FIG. 1, the gas mixing device of my invention is shown. A high pressure cylinder valve 12 is shown having a metal tube 16 brazed or silver soldered in the portion 11 of valve 12 which is threaded into the neck of a cylinder. The length of tube 16 is determined by the height of the cylinder and is open at the lower end. For a typical 330 lb cylinder, a tube of about 54" long is suitable. Groups of ⅛" holes 18 are drilled along tube 16. The separation A between holes 18*a* may be on the order of one inch. It will be noted that the next lower set 18*b* is drilled in tube 16 along a centerline 90° circumferentially from the centerline of holes 18*a*. The spacing D between sets of holes 18 may be on the order of three inches. This pattern is repeated along the tube 16 with the result that a series of sets of holes 18 essentially spiral around the tube 16 to the bottom end thereof. The open bottom end of tube 16 is preferably within about one inch of the bottom of the cylinder as indicated in FIG. 2.

In FIG. 2, a cylinder 20 is shown in cross-section with valve 12 installed in cylinder neck 21. It is assumed that a gas from storage under pressure, as indicated by arrow P, is being pumped into cylinder 20. The gas 25 will issue from each of the openings 18 in tube 16 filling the tank with essentially a uniform density. After the first gas is filled, the next gas is then introduced and will, as can be easily seen, disperse totally throughout the tank. As shown in the lateral cross-sectional view of FIG. 3, the gas 25 issuing at high velocity from holes 18 will strike the curved cylinder walls 22 and will be deflected circumferentially producing turbulence which will ensure complete mixing of the various gases.

Mixing tube 16 may be formed from brass, copper, steel or any other suitable metal. Plastic compatible with the gases to be filled may also be used and anchored in pressure reducing valve 12 with a suitable cement. As will now be recognized, a method of simultaneously filling and mixing diverse gases in a gas storage cylinder has been disclosed including the steps of:

filling a cylinder with a first gas having the lowest final gas pressure by means which distributes the gas over the entire length of the cylinder;

filling the cylinder with a second gas having the next lowest final gas pressure by means which distributes the gas over the entire length of the cylinder causing the first and second gases to mix thoroughly; and continuing these steps until all of the gases have been filled and mixed.

Although the invention has been disclosed with reference to a perforated tube for distributing gases over the entire length of a cylinder, it will be obvious to use alternative distribution means such as tubes with permeable walls, multiple tubes of varying lengths and other equivalent structures. Similarly, the method disclosed for mechanically attaching the mixing tube to the valve may be modified as will be obvious to those of skill in the art. Such modifications are considered to fall within the spirit and scope of the invention.

I claim:

1. A method of filling and mixing a plurality of gases in a gas storage cylinder comprising the steps of:

(a) disposing a gas inlet tube in and along the length of a gas storage cylinder, said tube having a plurality of openings through its walls, said openings distributed along the length of said tube;

(b) filling said cylinder with a first one of said gases having the lowest final gas pressure wherein said first gas is distributed along the entire cylinder;

(c) filling said cylinder with the second one of said gases having the next lowest final gas pressure wherein said second gas is distributed along the entire cylinder and is simultaneously mixed with said first gas; and (d) repeating the step (c) above for each one of said plurality of gases.

2. A device for filling an elongate gas storage cylinder having a top opening therein with a first gas having a first pressure and another gas having a second pressure greater than said first pressure in which said first and second gases have different densities and in which mixing of said first and second gases occurs during filling, comprising:

(a) a pressure control valve disposed in said top opening of said storage cylinder; and (b) mixing means communicating with said valve for sequentially injecting and mixing said first and second gases in said storage cylinder including (i) a tube depending from said valve to a point adjacent a bottom end of said storage cylinder, said tube having a plurality of openings along its length for distributing said first gas essentially uniformly along said storage cylinder, and (ii) in which said openings serve to direct said second gas radially outward to thereby strike the inner wall of said storage cylinder causing vertical and circumferential turbulence of said first and second gases to provide mixing thereof.

* * * * *